US011584150B2

(12) United States Patent
Nishide

(10) Patent No.: US 11,584,150 B2
(45) Date of Patent: Feb. 21, 2023

(54) PRINTING SYSTEM

(71) Applicant: SCREEN HOLDINGS CO., LTD., Kyoto (JP)

(72) Inventor: Hiroshi Nishide, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 80 days.

(21) Appl. No.: 17/166,695

(22) Filed: Feb. 3, 2021

(65) Prior Publication Data

US 2021/0300103 A1 Sep. 30, 2021

(30) Foreign Application Priority Data

Mar. 30, 2020 (JP) ..... JP2020-059762

(51) Int. Cl.
*B42C 19/02* (2006.01)
*B42C 11/04* (2006.01)

(52) U.S. Cl.
CPC ..... *B42C 19/02* (2013.01); *B42C 11/04* (2013.01); *B42P 2261/04* (2013.01)

(58) Field of Classification Search
CPC ..... B42C 19/02; B42C 11/04; B42C 19/08; B42C 1/12; B42P 2261/04
See application file for complete search history.

(56) References Cited

U.S. PATENT DOCUMENTS 3,892,427 A * 7/1975 Kraynak ..... B41J 29/40 270/58.08
6,206,358 B1 * 3/2001 Yamaguchi ..... B42C 19/02 270/52.02
6,857,796 B2 * 2/2005 Hatayama ..... B42C 19/02 358/1.6
7,236,934 B1 * 6/2007 Mayes ..... B42C 19/02 412/17
7,503,555 B2 * 3/2009 Dobrovolsky ..... B41F 17/02 270/52.17
8,313,276 B2 * 11/2012 Schmidkonz ..... B42C 11/04 412/4

(Continued)

FOREIGN PATENT DOCUMENTS

DE 102015213546 A1 1/2017
JP 11-105455 A 4/1999
WO 2011/108935 A1 9/2011

*Primary Examiner* — Patrick H Mackey
(74) *Attorney, Agent, or Firm* — McDermott Will & Emery LLP

(57) ABSTRACT

A printing system includes a book body printing section including a book body printing machine and outputting book bodies sequentially, and a cover printing section including a cover printing machine and outputting covers sequentially. The book body printing machine and the cover printing machine respectively receive printing order data indicating a printing order with regard to a plurality of jobs from a print control apparatus, and perform printing in the printing order indicated by the printing order data. The print control apparatus generates the printing order data, so that an inserting order in unit of job to a bookbinding machine of the book bodies output from the book body printing section coincides with an inserting order in unit of job to the bookbinding machine of the covers output from the cover printing section.

12 Claims, 9 Drawing Sheets

(56) References Cited

U.S. PATENT DOCUMENTS

| | | | | |
|---|---|---|---|---|
| 8,498,730 | B2 * | 7/2013 | Henry | G05B 19/4183 283/64 |
| 8,696,287 | B2 * | 4/2014 | Sturnick | B42C 19/02 412/4 |
| 10,815,096 | B2 * | 10/2020 | Bourg | B42C 11/00 |
| 2017/0129269 | A1 | 5/2017 | Dobrovolsky | |

* cited by examiner

JD (JOBS A TO D)
PRINT CONTROL APPARATUS
13
DD11
DD12
PD1 (PRINTING ORDER: D1 → C1 → B1 → A1)
PD2 (PRINTING ORDER: A2 → B2 → C2 → D2)
BOOK BODY PRINTING MACHINE
111
CUTTING MACHINE
112
D1
C1
B1
A1
113
TRANSFERRING /INSERTING ORDER
LAST
FIRST
114
COVER PRINTING MACHINE
121
D2
C2
B2
A2
122
COVER PROCESSING APPARATUS
123
124
91
92
BOOKBINDING MACHINE
90
A3
B3
C3
D3

PRINTING SYSTEM

BACKGROUND OF THE INVENTION

Field of the Invention

The present invention relates to a printing system, especially to a printing system that prints a plurality of elements constituting books, using different printing machines.

Description of Related Art

A book is constituted by a plurality of elements including a main section (hereinafter referred to as a book body), a cover, and the like. As for many books, the book bodies and the covers are printed on sheets of different kinds. Furthermore, laminate processing, scoring processing, or the like may be performed on the printed covers. Thus, in a typical printing system, the book bodies and the covers are printed using different printing machines. The book bodies and the covers are separately and sequentially output from the printing system. A bookbinding machine is provided in a later stage of the printing system. The bookbinding machine combines the book bodies and the covers to perform bookbinding.

As for bookbinding and shipping of the book, following methods are known. A first method is a method in which shipping is performed by hand. In this method, books after bookbinding are stored in a warehouse, and a worker gathers the books from the warehouse in accordance with an order, to perform shipping. A second method is a method in which the book bodies are printed digitally. In this method, printed covers are stored in the warehouse, and the book bodies are printed digitally in accordance with the order. The worker gathers the covers of the books from the warehouse in accordance with the order, and checks a book block (book body of one book) and the cover to insert them to a bookbinding machine.

A third method is a method in which an automatic warehouse is used. Also in this method, the printed covers are stored in the warehouse, and the book bodies are printed digitally in accordance with the order. Identification information (for example, barcode) of a job is printed on the book body. An automatic warehouse system reads the identification information printed on the book bodies, and takes out the covers automatically based on the read identification information. The book blocks and the covers are inserted to the bookbinding machine automatically.

Related to the invention of the present application, Japanese Laid-Open Patent Publication Hei 11-105455 discloses a bookbinding processing apparatus that reads, from a cover on which printing information including identification information is printed and a bundle of sheets including sheets on which printing information including the identification information is printed, the printing information printed on the cover and the bundle of sheets, and performs bookbinding process setting using the printing information read from the cover or the bundle of sheets, in order to prevent from performing bookbinding in a state where contents of the bundle of sheets and contents of the cover are different.

When performing bookbinding, it is necessary to insert the book bodies and the covers to the bookbinding machine with a correct correspondence. In conventional printing systems, performed is a method in which same books are printed repeatedly by the number of orders, in which it is not necessary to consider a bookbinding order. However, in recent years, printing of the books tends to be performed for many models in very small lots. Thus, it is necessary to insert the book bodies and the covers to the bookbinding machine with a correct correspondence, and this work becomes difficult. For example, there may be a case in which the worker restacks the covers in a reverse order before bookbinding. However, the restacking work is wasteful, and it may cause a bookbinding mistake. On the other hand, it takes a vast cost to store the covers of all books in the automatic warehouse.

SUMMARY OF THE INVENTION

Therefore, a purpose of the present invention is to provide a printing system that outputs a plurality of elements constituting books with a correct correspondence.

According to a first aspect of the present invention, there is provided a printing system that outputs first elements and second elements to a bookbinding machine performing bookbinding of books by combining the first elements and the second elements, the system including: a first printing section including a first printing machine configured to print the first elements, the first printing section configured to output the first elements sequentially; and a second printing section including a second printing machine configured to print the second elements, the second printing section configured to output the second elements sequentially, at least one of the first printing machine and the second printing machine is configured to receive printing order data indicating a printing order with regard to a plurality of jobs, and the at least one of the first printing machine and the second printing machine is configured to perform printing referring to the printing order data so that an inserting order in unit of job to the bookbinding machine of the first elements output from the first printing section coincides with an inserting order in unit of job to the bookbinding machine of the second elements output from the second printing section.

According to a second aspect of the present invention, in the first aspect of the present invention, the printing system further includes a print control apparatus configured to generate, as the printing order data, first printing order data indicating a printing order of the first elements and second printing order data indicating a printing order of the second elements, to output the first printing order data to the first printing machine, and to output the second printing order data to the second printing machine, the first printing machine is configured to print the first elements in the printing order indicated by the first printing order data, the second printing machine is configured to print the second elements in the printing order indicated by the second printing order data, and the print control apparatus is configured to generate the first printing order data and the second printing order data, so that the inserting order in unit of job to the bookbinding machine of the first elements output from the first printing section coincides with the inserting order in unit of job to the bookbinding machine of the second elements output from the second printing section.

According to a third aspect of the present invention, in the first aspect of the present invention, the first printing machine is configured to generate the printing order data indicating the printing order at time of printing the first elements with regard to the plurality of jobs, and to output the printing order data to the second printing machine, and the second printing machine is configured to determine a printing order of the second elements based on the printing order data, so that the inserting order in unit of job to the bookbinding machine of the first elements output from the first printing section coincides with the inserting order in unit of job to the bookbinding machine of the second elements output from the second printing section, and to print the second elements in the determined printing order.

According to a fourth aspect of the present invention, in the first aspect of the present invention, the second printing machine is configured to generate the printing order data indicating the printing order at time of printing the second elements with regard to the plurality of jobs, and to output the printing order data to the first printing machine, and the first printing machine is configured to determine a printing order of the first elements based on the printing order data, so that the inserting order in unit of job to the bookbinding machine of the first elements output from the first printing section coincides with the inserting order in unit of job to the bookbinding machine of the second elements output from the second printing section, and to print the first elements in the determined printing order.

According to a fifth aspect of the present invention, in the first aspect of the present invention, the first printing machine is configured to generate the printing order data indicating the printing order of the second elements based on a printing order at time of printing the first elements with regard to the plurality of jobs, and to output the printing order data to the second printing machine, the second printing machine is configured to print the second elements in the printing order indicated by the printing order data, and the first printing machine is configured to generate the printing order data, so that the inserting order in unit of job to the bookbinding machine of the first elements output from the first printing section coincides with the inserting order in unit of job to the bookbinding machine of the second elements output from the second printing section.

According to a sixth aspect of the present invention, in the first aspect of the present invention, the second printing machine is configured to generate the printing order data indicating the printing order of the first elements based on a printing order at time of printing the second elements with regard to the plurality of jobs, and to output the printing order data to the first printing machine, the first printing machine is configured to print the first elements in the printing order indicated by the printing order data, and the second printing machine is configured to generate the printing order data, so that the inserting order in unit of job to the bookbinding machine of the first elements output from the first printing section coincides with the inserting order in unit of job to the bookbinding machine of the second elements output from the second printing section.

According to a seventh aspect of the present invention, in the first aspect of the present invention, the second printing section includes an order obtaining apparatus configured to obtain an overlapping order in unit of job of the second elements printed by the second printing machine, and to output data indicating the overlapping order as the printing order data to the first printing machine, and the first printing machine is configured to determine a printing order of the first elements based on the printing order data, so that the inserting order in unit of job to the bookbinding machine of the first elements output from the first printing section coincides with the inserting order in unit of job to the bookbinding machine of the second elements output from the second printing section, and to print the first elements in the determined printing order.

According to an eighth aspect of the present invention, in the first aspect of the present invention, the first element is a book body, and the second element is a cover.

According to a ninth aspect of the present invention, in the first aspect of the present invention, the first printing machine is a continuous feed printing machine, and the second printing machine is a sheet fed printing machine.

According to a tenth aspect of the present invention, in the first aspect of the present invention, the second printing section further includes a processing apparatus configured to perform processing other than printing on the second elements printed by the second printing machine.

According to the first aspect, when the printing system performs printing with regard to the plurality of jobs, since the at least one of the first printing machine and the second printing machine performs printing referring to the printing order data, the inserting order in unit of job to the bookbinding machine of the first elements constituting the books can be made coincide with the inserting order in unit of job to the bookbinding machine of the second elements constituting the books, and a plurality of elements constituting the books can be output with a correct correspondence. Therefore, bookbinding can be performed correctly by combining the plurality of elements output from the printing system.

According to the second aspect, since the first printing machine and the second printing machine perform printing in the printing order indicated by the printing order data output from the print control apparatus, the plurality of elements constituting the books can be output with a correct correspondence.

According to the third aspect, since the second printing machine performs printing in the printing order determined based on the printing order data output from the first printing machine, the plurality of elements constituting the books can be output with a correct correspondence.

According to the fourth aspect, since the first printing machine performs printing in the printing order determined based on the printing order data output from the second printing machine, the plurality of elements constituting the books can be output with a correct correspondence.

According to the fifth aspect, since the second printing machine performs printing in the printing order indicated by the printing order data output from the first printing machine, the plurality of elements constituting the books can be output with a correct correspondence.

According to the sixth aspect, since the first printing machine performs printing in the printing order indicated by the printing order data output from the second printing machine, the plurality of elements constituting the books can be output with a correct correspondence.

According to the seventh aspect, since the first printing machine performs printing in the printing order determined based on the printing order data output from the order obtaining apparatus included in the second printing section, the plurality of elements constituting the books can be output with a correct correspondence.

According to the eighth aspect, the book bodies and the covers constituting the books can be output with a correct correspondence. Therefore, bookbinding can be performed correctly by combining the book bodies and the covers output from the printing system.

According to the ninth aspect, even when the first printing machine and the second printing machine are different in type, the plurality of elements constituting the books can be output with a correct correspondence.

According to the tenth aspect, even when the second printing section includes the processing apparatus, the plurality of elements constituting the books can be output with a correct correspondence.

These and other objects, features, modes, and effects of the present invention will be more apparent from the following detailed description with reference to the attached drawings.

DETAILED DESCRIPTION OF THE INVENTION

First Embodiment

Figure 1:
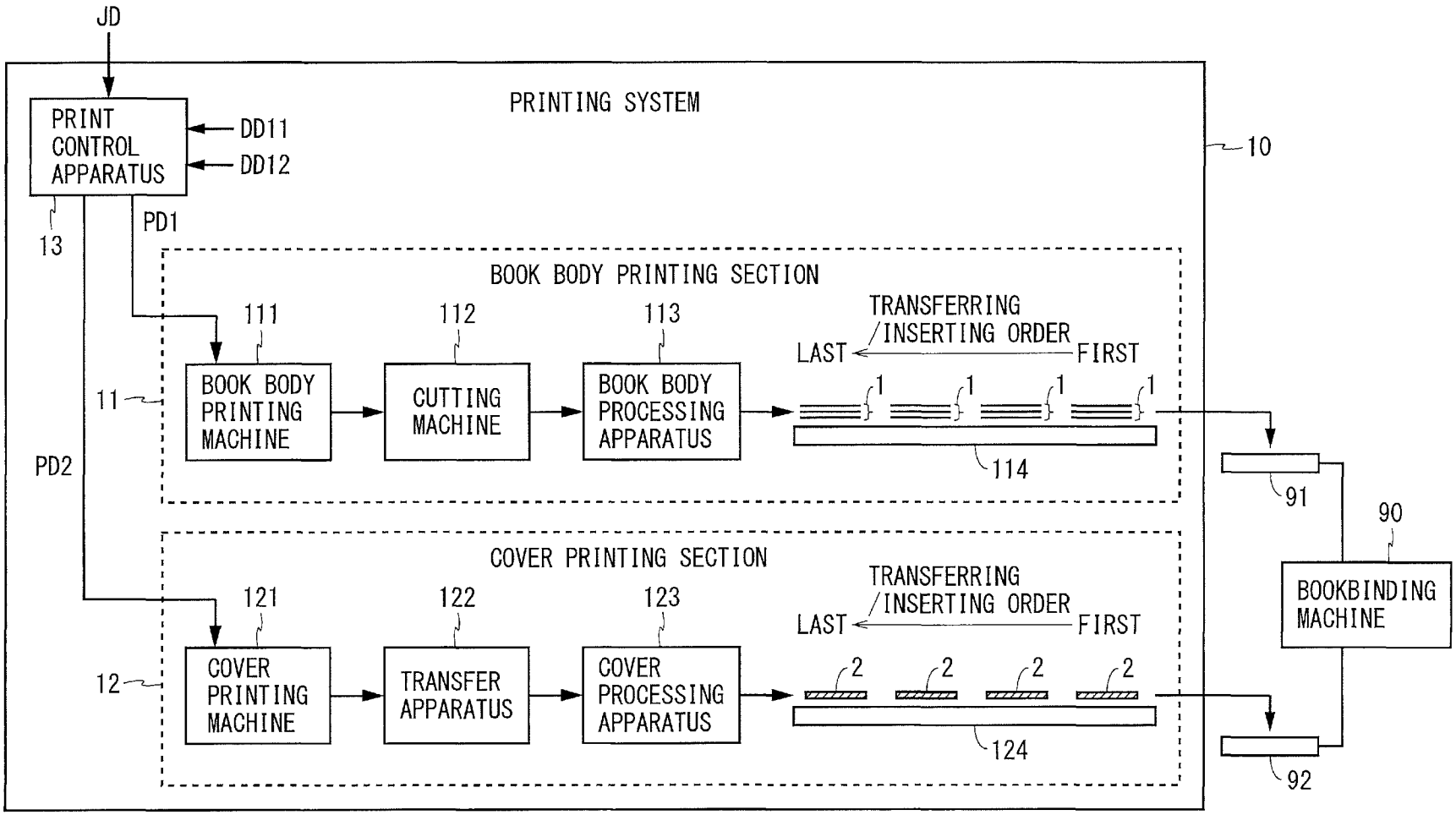
FIG. 1 is a block diagram showing a configuration of a printing system according to a first embodiment of the present invention.

FIG. 1 is a block diagram showing a configuration of a printing system according to a first embodiment of the present invention. A printing system 10 shown in FIG. 1 includes a book body printing section 11, a cover printing section 12, and a print control apparatus 13. The printing system 10 prints book bodies 1 and covers 2 constituting books, using different printing machines. The printing system 10 outputs the printed book bodies 1 and the printed covers 2 to a bookbinding machine 90. In the bookbinding machine 90, the book bodies 1 and the covers 2 are combined and subjected to bookbinding to form the books. The printing system 10 performs a plurality of printing jobs (hereinafter referred to as jobs) in accordance with an instruction provided externally.

The book body printing section 11 includes a book body printing machine 111, a cutting machine 112, a book body processing apparatus 113, and a transfer apparatus 114. The book body printing machine 111 prints the book bodies 1 of the books. The book body processing apparatus 113 performs processing on the printed book bodies 1. The printed and processed book bodies 1 are sequentially output in unit of book block from the book body printing section 11. The cover printing section 12 includes a cover printing machine 121, transfer apparatuses 122, 124, and a cover processing apparatus 123. The cover printing machine 121 prints the covers 2 of the books. The cover processing apparatus 123 performs processing on the printed covers 2. The printed and processed covers 2 are sequentially output from the cover printing section 12 one by one.

The bookbinding machine 90 having slots 91, 92 is provided in a later stage of the printing system 10. The book bodies 1 in unit of book block output from the book body printing section 11 are sequentially inserted to the slot 91. The covers 2 output from the cover printing section 12 are sequentially inserted to the slot 92 one by one. An inserting order in unit of job of the book bodies 1 to the bookbinding machine 90 is the same as an output order in unit of job of the book bodies 1 from the book body printing section 11. An inserting order in unit of job of the covers 2 to the bookbinding machine 90 is the same as an output order in unit of job of the covers 2 from the cover printing section 12.

The book body printing machine 111 is a continuous feed printing machine that performs continuous feed printing on a roll paper. The cutting machine 112 pulls out the printed roll paper from an outside, and cuts the pulled-out roll paper to obtain the book bodies 1 consisting of a plurality of sheets. The printed book bodies 1 are output from the cutting machine 112 in an overlapping state. The book body processing apparatus 113 takes out the cut book bodies 1 that are in the overlapping state sequentially from the top, performs processing such as bending processing, and outputs the book body 1 of one book in unit of book block (that is, book body 1 in unit of book block). The transfer apparatus 114 transfers the book bodies 1 in unit of book block to the slot 91 of the bookbinding machine 90 in a processing order.

When the book body printing machine 111 performs printing with regard to the plurality of jobs, in the printed roll paper, the book body 1 related to a job performed earlier is included in an inside portion of the roll paper, and the book body 1 related to a job performed later is included in an outside portion of the roll paper. Thus, in the book bodies 1 output from the cutting machine 112, the former book body 1 is included in an upper portion of the overlap, and the latter book body 1 is included in a lower portion of the overlap. Therefore, the book bodies 1 are output from the cutting machine 112 in unit of job in an overlapping state from top to bottom in the printing order. The book body printing section 11 sequentially outputs the book bodies 1 in unit of job.

The cover printing machine 121 is a sheet fed printing machine that performs printing on sheets. The printed covers 2 are output from the cover printing machine 121 in an overlapping state. The transfer apparatus 122 makes bundles corresponding to an appropriate number of books based on the printed covers 2 in the overlapping state, and transfers the bundles to the cover processing apparatus 123 with keeping the overlapping state. The cover processing apparatus 123 performs processing other than printing (for example, laminate processing, scoring processing, or the like) on the printed covers 2. The printed and processed covers 2 are output from the cover processing apparatus 123 one by one. The transfer apparatus 124 transfers the printed and processed covers 2 to the slot 92 one by one.

When the cover printing machine 121 performs printing with regard to the plurality of jobs, in the covers 2 output from the cover printing machine 121, the cover 2 related to the job performed earlier is included in a lower portion of the overlap, and the cover 2 related to the job performed later is included in an upper portion of the overlap. Therefore, the covers 2 are output from the cover printing machine 121 in unit of job in an overlapping state from top to bottom in a reverse order of the printing order. The cover processing apparatus 123 outputs the covers 2 output from the cover printing machine 121 in the same order in the overlapping state, or outputs them in a reverse order in the overlapping state. The order in which the covers 2 are output is determined depending on a configuration, an operation status, or the like of the cover processing apparatus 123.

The bookbinding machine 90 combines the book body 1 inserted to the slot 91 and the cover 2 correspondingly inserted to the slot 92 to perform bookbinding. In order to perform bookbinding correctly, it is required that an inserting order in unit of job to the slot 91 of the book bodies 1 coincide with an inserting order in unit of job to the slot 92 of the covers 2. In other words, it is required that an inserting order (inserting order to slot 91) in unit of job to the bookbinding machine 90 of the book bodies 1 output from the book body printing section 11 coincide with an inserting order (inserting order to slot 92) in unit of job to the bookbinding machine 90 of the covers 2 output from the cover printing section 12. However, unless any special devise is performed, the two orders may not coincide depending on configurations, operation statuses, or the like of the book body processing apparatus 113 or the cover processing apparatus 123.

In order to solve the above-described problem, the printing system 10 includes the print control apparatus 13 that outputs printing order data. The printing order data are data indicating a printing order with regard to the plurality of jobs. Job data JD indicating the plurality of jobs that should be performed by the printing system 10 are input to the print control apparatus 13. The print control apparatus 13 generates, as the printing order data, first printing order data PD1 indicating a printing order of the book bodies 1 and second printing order data PD2 indicating a printing order of the covers 2, based on the job data JD, apparatus related information DD11 of the book body printing section 11, and apparatus related information DD12 of the cover printing section 12 (details of these will be described later). The first printing order data PD1 and the second printing order data PD2 are determined, so that the inserting order in unit of job to the bookbinding machine 90 of the book bodies 1 output from the book body printing section 11 coincides with the inserting order in unit of job to the bookbinding machine 90 of the covers 2 output from the cover printing section 12.

The print control apparatus 13 outputs the first printing order data PD1 to the book body printing machine 111, and outputs the second printing order data PD2 to the cover printing machine 121. The book body printing machine 111 receives the first printing order data PD1 from the print control apparatus 13, and prints the book bodies 1 in the printing order indicated by the first printing order data PD1. The cover printing machine 121 receives the second printing order data PD2 from the print control apparatus 13, and prints the covers 2 in the printing order indicated by the second printing order data PD2. Therefore, in the printing system 10, the inserting order in unit of job to the bookbinding machine 90 of the book bodies 1 output from the book body printing section 11 coincides with the inserting order in unit of job to the bookbinding machine 90 of the covers 2 output from the cover printing section 12. As a result, the bookbinding machine 90 can perform bookbinding correctly by combining the book bodies 1 and the covers 2.

Figure 2:
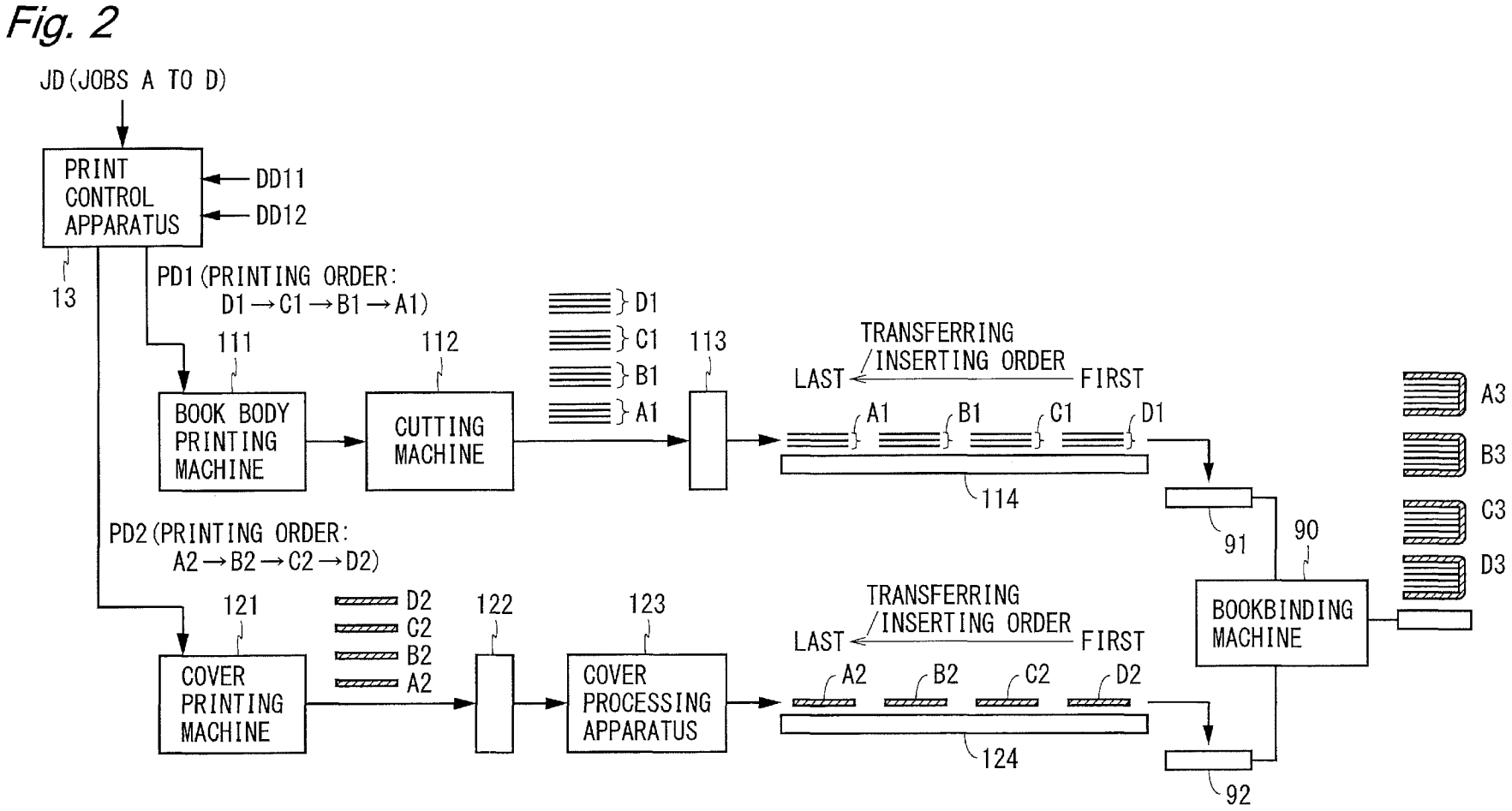
FIG. 2 is a diagram showing an example of an operation of the printing system shown in FIG. 1.

FIG. 2 is a diagram showing an example of an operation of the printing system 10. A case where the printing system 10 performs four different jobs A to D is described here. It is assumed that each of the jobs A to D is a job for printing a book constituted by a book body and a cover, and the cover processing apparatus 123 outputs the covers output from the cover printing machine 121 in a processing order. Book bodies related to the jobs A to D are respectively referred to as A1 to D1, covers related to the jobs A to D are respectively referred to as A2 to D2, and books related to the jobs A to D are respectively referred to A3 to D3.

Job data JD indicating the jobs A to D are input to the print control apparatus 13. The print control apparatus 13 generates the first printing order data PD1 indicating the printing order of the book bodies 1 and the second printing order data PD2 indicating the printing order of the covers 2, based on the job data JD, the apparatus related information DD11 of the book body printing section 11, and the apparatus related information DD12 of the cover printing section 12. The first printing order data PD1 indicate that the book bodies A1 to D1 are to be printed in an order of D1, C1, B1, and A1. The second printing order data PD2 indicate that the covers A2 to D2 are to be printed in an order of A2, B2, C2, and D2.

The print control apparatus 13 outputs the first printing order data PD1 to the book body printing machine 111. The book body printing machine 111 prints the book bodies A1 to D1 in the printing order indicated by the first printing order data PD1. The book bodies are output from the cutting machine 112 in unit of job in an overlapping state from top to bottom in the printing order. Thus, the book bodies A1 to D1 are output from the cutting machine 112 in the overlapping state from top to bottom in the order of D1, C1, B1, and A1. The book body processing apparatus 113 takes out the book bodies A1 to D1 in the order of D1, C1, B1, and A1, and outputs the book bodies 1 in unit of book block. The transfer apparatus 114 transfers the book bodies A1 to D1 in the order of D1, C1, B1, and A1.

The print control apparatus 13 outputs the second printing order data PD2 to the cover printing machine 121. The cover printing machine 121 prints the covers A2 to D2 in the printing order indicated by the second printing order data PD2. The covers are output from the cover printing machine 121 in unit of job in an overlapping state from top to bottom in a reverse order of the printing order. Thus, the covers A2 to D2 are output from the cover printing machine 121 in the overlapping state from top to bottom in an order of D2, C2, B2, and A2. The cover processing apparatus 123 outputs the covers A2 to D2 in the order of D2, C2, B2, and A2. The transfer apparatus 124 transfers the covers A2 to D2 in the order of D2, C2, B2, and A2.

The book bodies A1 to D1 are inserted to the slot 91 in the order of D1, C1, B1, and A1. The covers A2 to D2 are inserted to the slot 92 in the order of D2, C2, B2, and A2. At first, the bookbinding machine 90 combines the book body D1 and the cover D2 to perform bookbinding, and outputs the book D3. Next, the bookbinding machine 90 combines the book body C1 and the cover C2 to perform bookbinding, and outputs the book C3. Next, the bookbinding machine 90 combines the book body B1 and the cover B2 to perform bookbinding, and outputs the book B3. Next, the bookbinding machine 90 combines the book body A1 and the cover A2 to perform bookbinding, and outputs the book A3. The books A3 to D3 are output from the bookbinding machine 90 in an overlapping state from top to bottom in an order of A3, B3, C3, and D3.

The apparatus related information DD11 of the book body printing section 11 will be described. As described above, the book body printing section 11 includes the book body printing machine 111, the cutting machine 112, the book body processing apparatus 113, and the transfer apparatus 114. The book body printing machine 111 and the cutting machine 112 output the book bodies A1 to D1 in the same order as the provided printing order in the overlapping state from top to bottom in the order of D1, C1, B1, and A1. The book body processing apparatus 113 processes the book bodies A1 to D1 in the above-described order, and the transfer apparatus 114 transfers the book bodies A1 to D1 in the above-described order. The apparatus related information DD11 of the book body printing section 11 is information related to a group of apparatuses included in the book body printing section 11, and includes information indicating a correspondence relation between a printing order of the jobs A to D in an apparatus (book body printing machine 111) positioned at a most upstream in the group of apparatuses and an output order of the book bodies A1 to D1 output from an apparatus (transfer apparatus 114) positioned at a most downstream in the group of apparatuses.

The apparatus related information DD12 of the cover printing section 12 will be described. As described above, the cover printing section 12 includes the cover printing machine 121, the transfer apparatuses 122, 124, and the cover processing apparatus 123. The cover printing machine 121 outputs the covers A2 to D2 in a reverse order of the provided printing order in the overlapping state from top to bottom in the order of D2, C2, B2, and A2. The transfer apparatus 122 and the cover processing apparatus 123 do not change the overlapping order of the covers A2 to D2. The transfer apparatus 124 transfers the covers A2 to D2 in the order of D2, C2, B2, and A2. The apparatus related information DD12 of the cover printing section 12 is information related to apparatuses included in the cover printing section 12, and includes information indicating a correspondence relation between a printing order of the jobs A to D in an apparatus (cover printing machine 121) positioned at a most upstream in the group of apparatuses and an output order of the covers A2 to D2 output from an apparatus (transfer apparatus 124) positioned at a most downstream in the group of the apparatuses.

Note that although in the example shown in FIG. 2, each of the jobs A to D is a job for printing one book, each of the jobs A to D may be a job for printing a plurality of books.

As described above, the printing system 10 according to the present embodiment is a printing system that outputs first elements (book bodies 1) and second elements (covers 2) to the bookbinding machine 90 performing bookbinding of books by combining the first elements and the second elements, and includes a first printing section (book body printing section 11) including a first printing machine (book body printing machine 111) that prints the first elements and outputting the first elements sequentially, and a second printing section (cover printing section 12) including a second printing machine (cover printing machine 121) that prints the second elements and outputting the second elements sequentially. The first printing machine and the second printing machine receive printing order data (first printing order data PD1 and second printing order data PD2) indicating a printing order with regard to a plurality of jobs. The first printing machine and the second printing machine perform printing referring to the printing order data so that an inserting order (inserting order to slot 91) in unit of job to the bookbinding machine 90 of the first elements output from the first printing section coincides with an inserting order (inserting order to slot 92) in unit of job to the bookbinding machine 90 of the second elements output from the second printing section.

According to the printing system 10, since the first printing machine and the second printing machine perform printing referring to the printing order indicated by the printing order data, the inserting order in unit of job to the bookbinding machine 90 of the first elements constituting the books can be made coincide with the inserting order in unit of job to the bookbinding machine 90 of the second elements constituting the books, and a plurality of elements (book bodies 1 and covers 2) constituting the books can be output with a correct correspondence. Therefore, the bookbinding machine 90 can perform bookbinding correctly by combining the plurality of elements constituting the books.

The printing system 10 further includes the print control apparatus 13 that generates, as the printing order data, the first printing order data PD1 indicating a printing order of the first elements and the second printing order data PD2 indicating a printing order of the second elements, outputs the first printing order data PD1 to the first printing machine, and outputs the second printing order data PD2 to the second printing machine. The first printing machine prints the first elements in the printing order indicated by the first printing order data PD1, and the second printing machine prints the second elements in the printing order indicated by the second printing order data PD2. The print control apparatus 13 generates the first printing order data PD1 and the second printing order data PD2, so that the inserting order in unit of job to the bookbinding machine 90 of the first elements output from the first printing section coincides with the inserting order in unit of job to the bookbinding machine 90 of the second elements output from the second printing section. When generating the first printing order data PD1 and the second printing order data PD2, the print control apparatus 13 refers to apparatus related information of the first printing section (apparatus related information DD11) and apparatus related information of the second printing section (apparatus related information DD12). Therefore, since the first printing machine and the second printing machine perform printing in the printing order indicated by the printing order data output from the print control apparatus 13, the plurality of elements constituting the books can be output with a correct correspondence.

The first printing machine is a continuous feed printing machine, and the second printing machine is a sheet fed printing machine. Even when the first printing machine and the second printing machine are different in type, the plurality of elements constituting the books can be output with a correct correspondence. Furthermore, the second printing section further includes a processing apparatus (cover processing apparatus 123) that performs processing other than printing on the second elements printed by the second printing machine. Even when the second printing section includes the processing apparatus, the plurality of elements constituting the books can be output with a correct correspondence.

Second Embodiment

Figure 3:
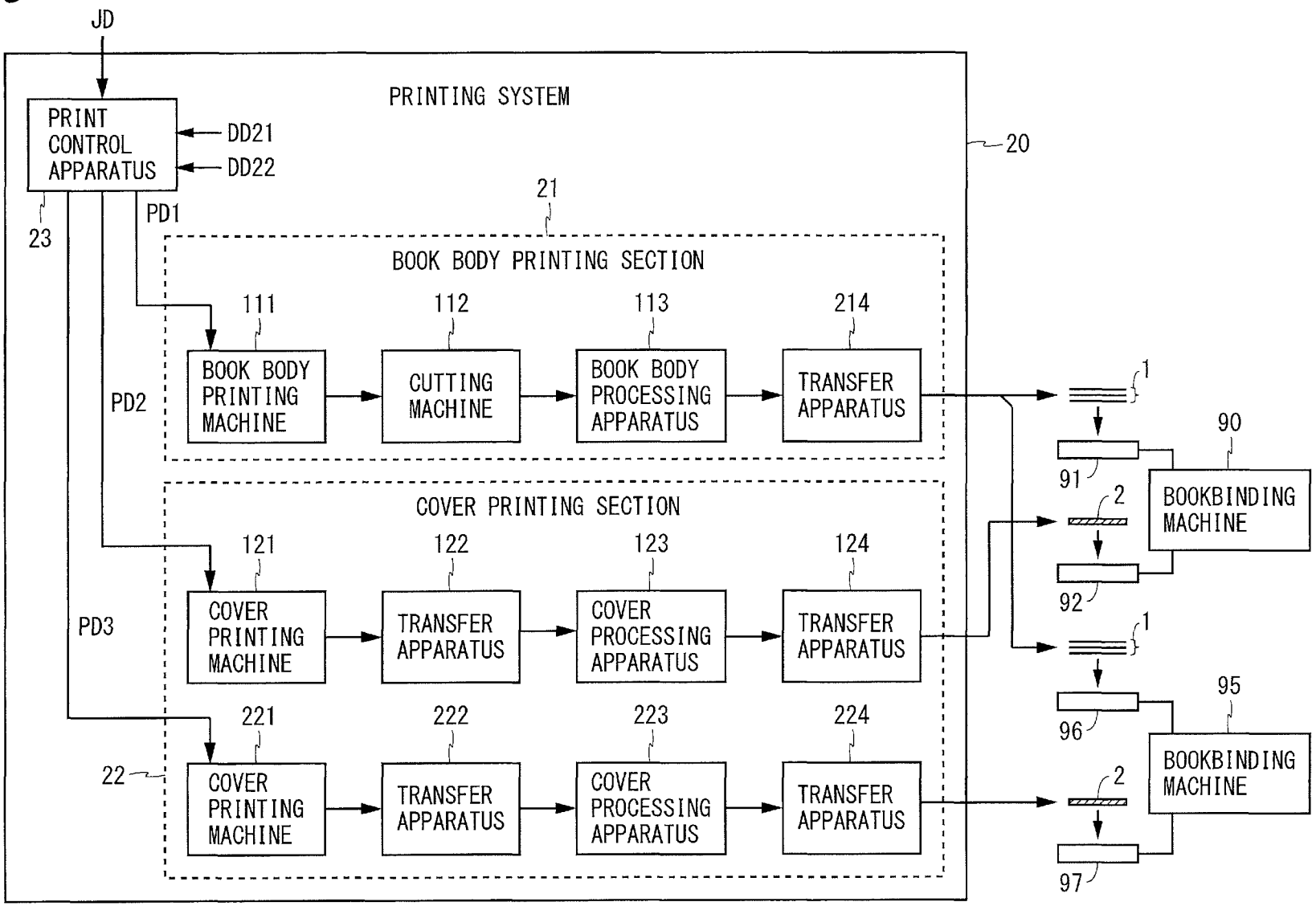
FIG. 3 is a block diagram showing a configuration of a printing system according to a second embodiment of the present invention.

FIG. 3 is a block diagram showing a configuration of a printing system according to a second embodiment of the present invention. A printing system 20 shown in FIG. 3 includes a book body printing section 21, a cover printing section 22, and a print control apparatus 23. In the following embodiments, differences from the first embodiment will be described. Among components of each embodiment, those described in a formerly-described embodiment are provided with same reference numbers, and their descriptions are omitted.

The book body printing section 21 is obtained based on the book body printing section 11 according to the first embodiment by replacing the transfer apparatus 114 with a transfer apparatus 214. Unlike the book body printing section 11, the book body printing section 21 selectively outputs the book bodies 1 printed based on the plurality of different jobs to a plurality (here, two) of bookbinding machines 90, 95.

The cover printing section 22 is obtained by adding, to the cover printing section 12 according to the first embodiment, a cover printing machine 221, transfer apparatuses 222, 224, and a cover processing apparatus 223. The cover printing machine 221, the transfer apparatus 222, and the cover processing apparatus 223 operate in a manner similar to the cover printing machine 121, the transfer apparatus 122, and the cover processing apparatus 123, respectively. Unlike the cover printing section 12, the cover printing section 22 selectively outputs the covers 2 printed based on the plurality of different jobs to the plurality (here, two) of bookbinding machines 90, 95.

In a later stage of the printing system 20, the bookbinding machine 95 having slots 96, 97 is provided in addition to the bookbinding machine 90 having the slots 91, 92. The book bodies 1 in unit of book block that are output from the book body printing section 21 are inserted to the slots 91, 96 sequentially. The covers 2 output from the cover printing section 22 are inserted to the slots 92, 97 one by one.

The transfer apparatus 214 transfers to the slot 91 a part of the book bodies 1 output from the book body processing apparatus 113 with keeping a receiving order, and transfers to the slot 96 the remaining part of the book bodies 1 output from the book body processing apparatus 113 with keeping the receiving order. The transfer apparatus 224 transfers to the slot 97 the covers 2 output from the cover processing apparatus 223.

Job data JD indicating a plurality of jobs that should be performed by the printing system 20 are input to the print control apparatus 23. The print control apparatus 23 generates, as the printing order data, the first printing order data PD1 indicating the printing order of the book bodies 1, the second printing order data PD2 indicating the printing order of the covers 2 at the cover printing machine 121, and third printing order data PD3 indicating the printing order of the covers 2 at the cover printing machine 221, based on the job data JD, apparatus related information DD21 of the book body printing section 21, and apparatus related information DD22 of the cover printing section 22. The first to third printing order data PD1 to PD3 are determined, so that inserting orders in unit of job to the bookbinding machines 90, 95 of the book bodies 1 coincide with inserting orders in unit of job to the bookbinding machines 90, 95 of the covers 2 for each group.

The print control apparatus 23 outputs the first printing order data PD1 to the book body printing machine 111, outputs the second printing order data PD2 to the cover printing machine 121, and outputs the third printing order data PD3 to the cover printing machine 221. The book body printing machine 111 receives the first printing order data PD1 from the print control apparatus 23, and prints the book bodies 1 in the printing order indicated by the first printing order data PD1. The cover printing machine 121 receives the second printing order data PD2 from the print control apparatus 23, and prints the covers 2 in the printing order indicated by the second printing order data PD2. The cover printing machine 221 receives the third printing order data PD3 from the print control apparatus 23, and prints the covers 2 in the printing order indicated by the third printing order data PD3. Therefore, in the printing system 20, the inserting orders in unit of job of the book bodies 1 coincide with the inserting orders in unit of job of the covers 2, in the bookbinding machines 90, 95.

Figure 4:
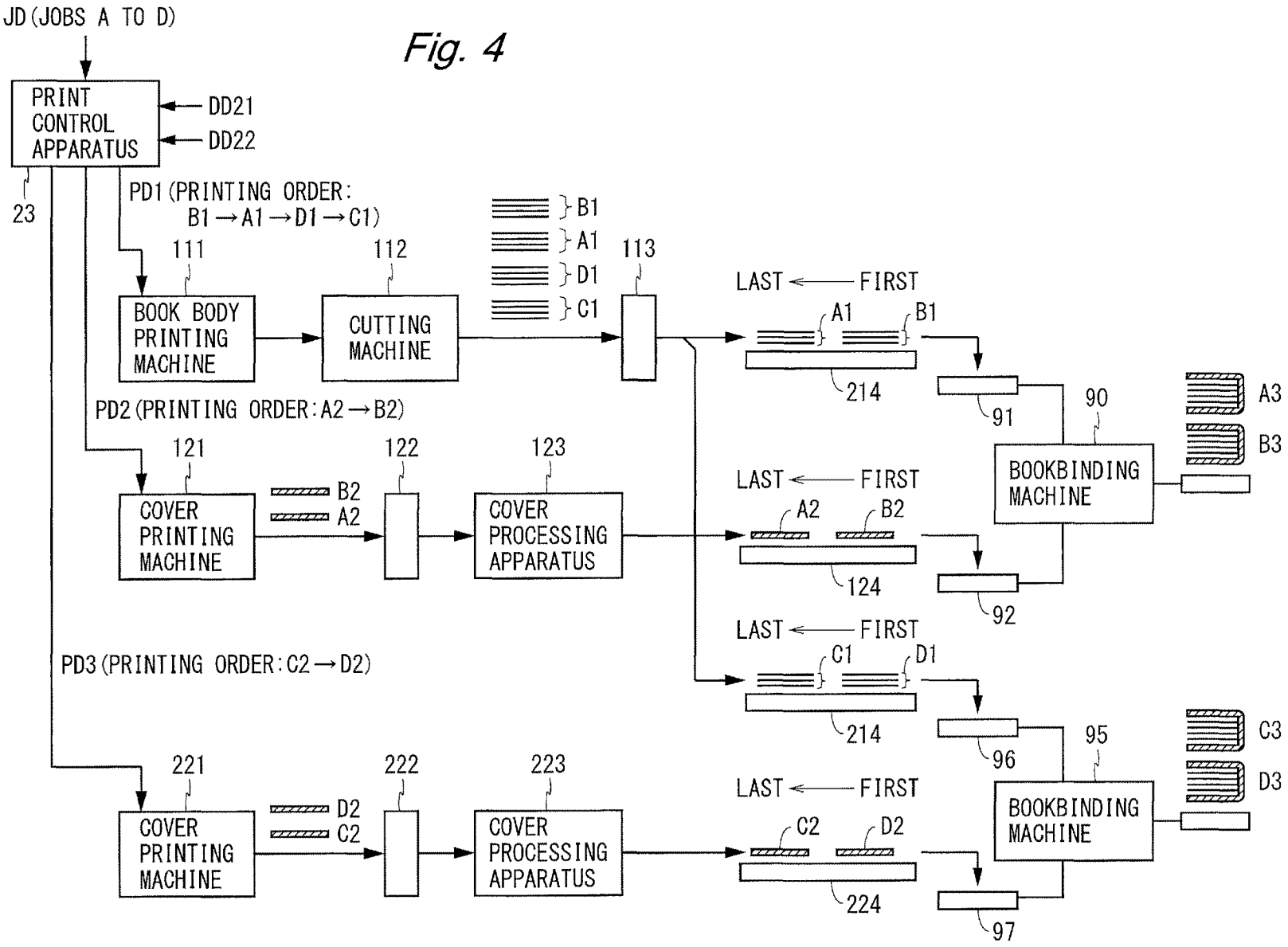
FIG. 4 is a diagram showing an example of an operation of the printing system shown in FIG. 3.

FIG. 4 is a diagram showing an example of an operation of the printing system 20. As with the example shown in FIG. 2, a case where the printing system 20 performs the jobs A to D will be described. In the printing system 20, the covers A2, B2 are printed by the cover printing machine 121, and the covers C2, D2 are printed by the cover printing machine 221.

The job data JD indicating the jobs A to D are input to the print control apparatus 23. The job data JD according to the present embodiment include information indicating the book bodies 1 and the covers 2 that are printed based on the job should be subjected to bookbinding in any of the bookbinding machines 90, 95. The print control apparatus 23 generates the first printing order data PD1 indicating the printing order of the book bodies 1, the second printing order data PD2 indicating the printing order of the covers 2 at the cover printing machine 121, and the third printing order data PD3 indicating the printing order of the covers 2 at the cover printing machine 221, based on the job data JD, the apparatus related information DD21 of the book body printing section 21, and the apparatus related information DD22 of the cover printing section 22. The first printing order data PD1 indicate that the book bodies A1 to D1 are to be printed in an order of B1, A1, D1, and C1. The second printing order data PD2 indicate that the covers A2, B2 are to be printed in an order of A2 and B2. The third printing order data PD3 indicate that the covers C2, D2 are to be printed in an order of C2 and D2.

The print control apparatus 23 outputs the first printing order data PD1 to the book body printing machine 111. The book body printing machine 111 prints the book bodies A1 to D1 in the printing order indicated by the first printing order data PD1. The book bodies A1 to D1 are output from the cutting machine 112 in an overlapping state from top to bottom in the order of B1, A1, D1, and C1.

The print control apparatus 23 outputs the second printing order data PD2 to the cover printing machine 121. The cover printing machine 121 prints the covers A2, B2 in the printing order indicated by the second printing order data PD2. The covers A2, B2 are output from the cover printing machine 121 in an overlapping state from top to bottom in an order of B2 and A2. The covers A2, B2 are output from the cover processing apparatus 123 and the cover printing section 22 in the order of B2 and A2.

The print control apparatus 23 outputs the third printing order data PD3 to the cover printing machine 221. The cover printing machine 221 prints the covers C2, D2 in the printing order indicated by the third printing order data PD3. The covers C2, D2 are output from the cover printing machine 221 in an overlapping state from top to bottom in an order of D2 and C2. The covers C2, D2 are output from the cover processing apparatus 223 and the cover printing section 22 in the order of D2 and C2.

Among the book bodies A1 to D1, the book bodies A1, B1 respectively correspond to the covers A2, B2 printed by the cover printing machine 121, and the book bodies C1, D1 respectively correspond to the covers C2, D2 printed by the cover printing machine 221. The transfer apparatus 214 transfers the book bodies A1, B1 to the slot 91, and transfers the book bodies C1, D1 to the slot 96.

The book bodies A1, B1 are inserted to the slot 91 in an order of B1 and A1. The covers A2, B2 are inserted to the slot 92 in the order of B2 and A2. At first, the bookbinding machine 90 combines the book body B1 and the cover B2 to perform bookbinding, and outputs the book B3. Next, the bookbinding machine 90 combines the book body A1 and the cover A2 to perform bookbinding, and outputs the book A3. The books A3, B3 are output from the bookbinding machine 90 in an overlapping state from top to bottom in an order of A3 and B3.

The book bodies C1, D1 are inserted to the slot 96 in an order of D1 and C1. The covers C2, D2 are inserted to the slot 97 in the order of D2 and C2. At first, the bookbinding machine 95 combines the book body D1 and the cover D2 to perform bookbinding, and outputs the book D3. Next, the bookbinding machine 95 combines the book body C1 and the cover C2 to perform bookbinding, and outputs the book C3. The books C3, D3 are output from the bookbinding machine 95 in an overlapping state from top to bottom in an order of C3 and D3.

According to the printing system 20 according to the present embodiment, as with the first embodiment, since the first printing machine (book body printing machine 111) and the second printing machine (cover printing machines 121, 221) perform printing in the printing order indicated by the printing order data (first to third printing order data PD1 to PD3) output from the print control apparatus 23, the inserting order in unit of job to the bookbinding machine 90 of the book bodies A1, B1 output from the book body printing section 21 can be made coincide with the inserting order in unit of job to the bookbinding machine 90 of the covers A2, B2 output from the cover printing section 22, and bookbinding can be performed correctly by the bookbinding machine 90. Furthermore, the inserting order in unit of job to the bookbinding machine 95 of the book bodies C1, D1 output from the book body printing section 21 can be made coincide with the inserting order in unit of job to the bookbinding machine 95 of the covers C2, D2 output from the cover printing section 22, and bookbinding can be performed correctly by the bookbinding machine 95.

Third Embodiment

Figure 5:
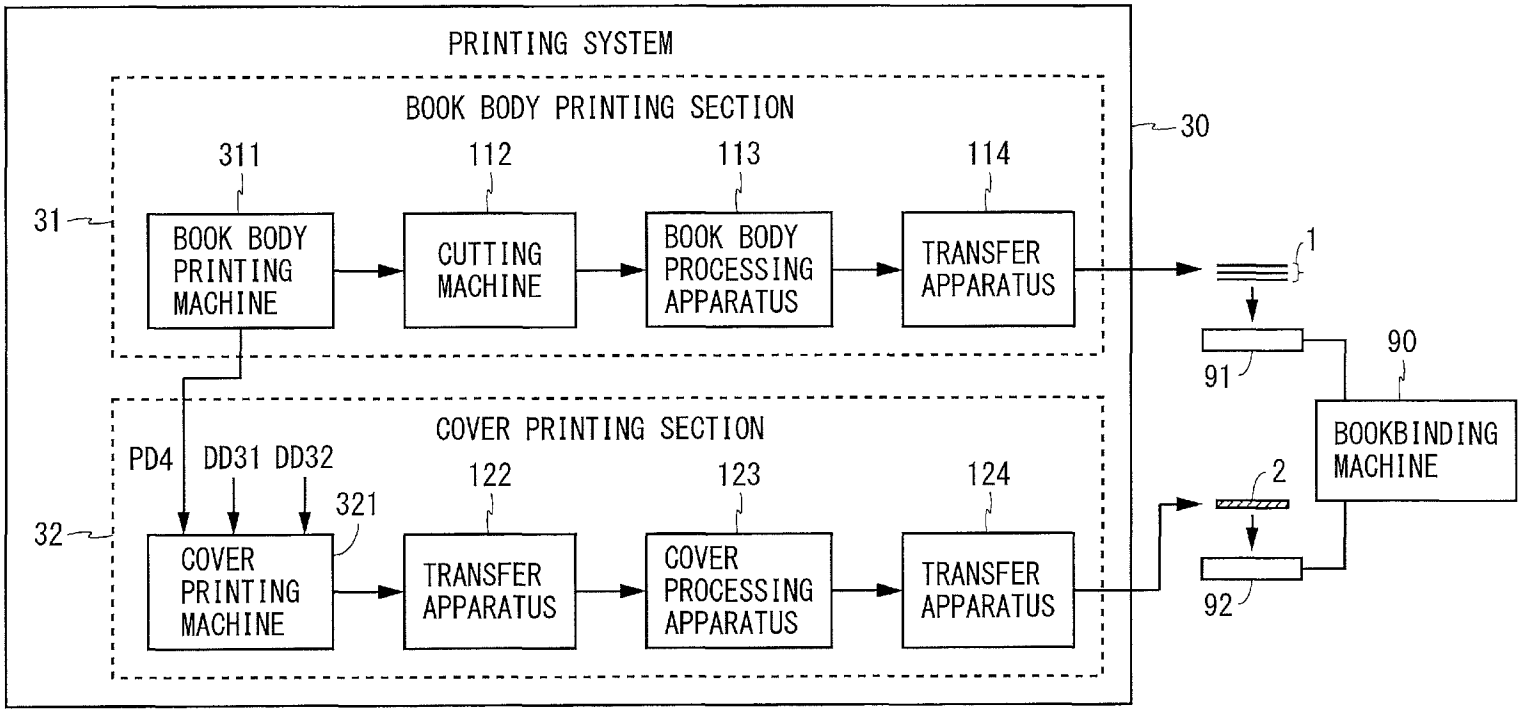
FIG. 5 is a block diagram showing a configuration of a printing system according to a third embodiment of the present invention.

FIG. 5 is a block diagram showing a configuration of a printing system according to a third embodiment of the present invention. A printing system 30 shown in FIG. 5 includes a book body printing section 31 and a cover printing section 32. The book body printing section 31 is obtained based on the book body printing section 11 according to the first embodiment by replacing the book body printing machine 111 with a book body printing machine 311. The cover printing section 32 is obtained based on the cover printing section 12 according to the first embodiment by replacing the cover printing machine 121 with a cover printing machine 321.

The book body printing machine 311 is obtained by adding, to the book body printing machine 111, a function of outputting printing order data PD4. The book body printing machine 311 generates the printing order data PD4 indicating a printing order at time of printing the book bodies 1 with regard to a plurality of jobs, and outputs the printing order data PD4 to the cover printing machine 321.

The cover printing machine 321 is obtained by adding, to the cover printing machine 121, a function of determining a printing order of the covers 2 based on the received printing order data PD4. The cover printing machine 321 receives the printing order data PD4 from the book body printing machine 311, determines the printing order of the covers 2 based on the printing order data PD4, apparatus related information DD31 of the book body printing section 31, and apparatus related information DD32 of the cover printing section 32, and prints the covers 2 in the determined printing order. The cover printing machine 321 determines the printing order of the covers 2, so that an inserting order in unit of job to the bookbinding machine 90 of the book bodies 1 output from the book body printing section 31 coincides with an inserting order in unit of job to the bookbinding machine 90 of the covers 2 output from the cover printing section 32.

As described above, in the printing system 30 according to the present embodiment, the first printing machine (book body printing machine 311) generates the printing order data PD4 indicating a printing order at time of printing the first elements (book bodies 1) with regard to the plurality of jobs, and outputs the printing order data PD4 to the second printing machine (cover printing machine 321). The second printing machine determines the printing order of the second elements based on the printing order data PD4, so that the inserting order in unit of job to the bookbinding machine 90 of the first elements output from the first printing section (book body printing section 31) coincides with the inserting order in unit of job to the bookbinding machine 90 of the second elements (covers 2) output from the second printing section (cover printing section 32), and prints the second elements in the determined printing order. When determining the printing order of the second elements, the second printing machine refers to the printing order data PD4, the apparatus related information of the first printing section (apparatus related information DD31), and the apparatus related information of the second printing section (apparatus related information DD32).

According to the printing system 30, since the second printing machine performs printing in the printing order determined based on the printing order data PD4 output from the first printing machine, the plurality of elements (book bodies 1 and covers 2) constituting the books can be output to the bookbinding machine 90 with a correct correspondence.

Fourth Embodiment

Figure 6:
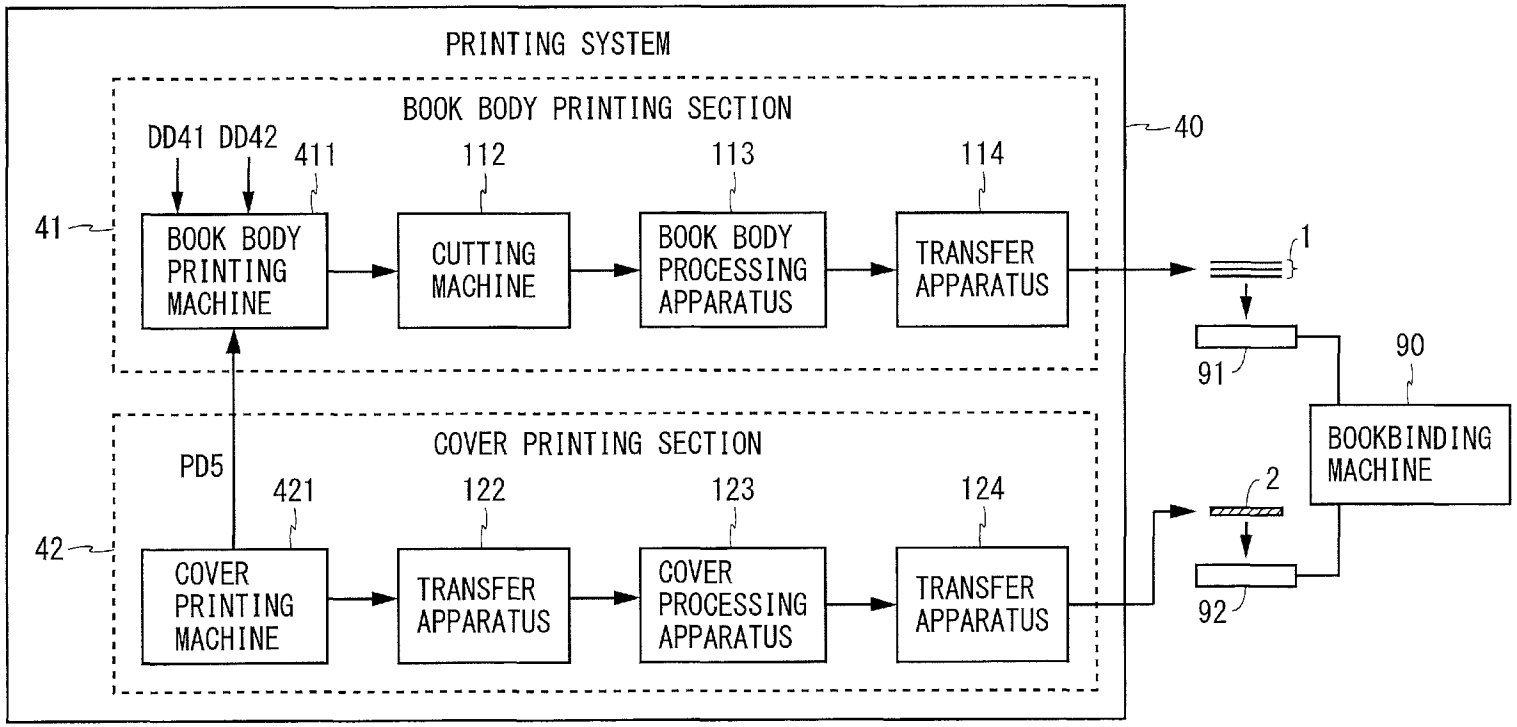
FIG. 6 is a block diagram showing a configuration of a printing system according to a fourth embodiment of the present invention.

FIG. 6 is a block diagram showing a configuration of a printing system according to a fourth embodiment of the present invention. A printing system 40 shown in FIG. 6 includes a book body printing section 41 and a cover printing section 42. The book body printing section 41 is obtained based on the book body printing section 11 according to the first embodiment by replacing the book body printing machine 111 with a book body printing machine 411. The cover printing section 42 is obtained based on the cover printing section 12 according to the first embodiment by replacing the cover printing machine 121 with a cover printing machine 421.

The cover printing machine 421 is obtained by adding, to the cover printing machine 121, a function of outputting printing order data PD5. The cover printing machine 421 generates the printing order data PD5 indicating a printing order at time of printing the covers 2 with regard to a plurality of jobs, and outputs the printing order data PD5 to the book body printing machine 411.

The book body printing machine 411 is obtained by adding, to the book body printing machine 111, a function of determining a printing order of the book bodies 1 based on the received printing order data PD5. The book body printing machine 411 receives the printing order data PD5 from the cover printing machine 421, determines the printing order of the book bodies 1 based on the printing order data PD5, apparatus related information DD41 of the book body printing section 41, and apparatus related information DD42 of the cover printing section 42, and prints the book bodies 1 in the determined printing order. The book body printing machine 411 determines the printing order of the book bodies 1, so that an inserting order in unit of job to the bookbinding machine 90 of the book bodies 1 output from the book body printing section 41 coincides with an inserting order in unit of job to the bookbinding machine 90 of the covers 2 output from the cover printing section 42.

As described above, in the printing system 40 according to the present embodiment, the second printing machine (cover printing machine 421) generates the printing order data PD5 indicating a printing order at time of printing the second elements (covers 2) with regard to the plurality of jobs, and outputs the printing order data PD5 to the first printing machine (book body printing machine 411). The first printing machine determines the printing order of the first elements based on the printing order data PD5, so that the inserting order in unit of job to the bookbinding machine 90 of the first elements (book bodies 1) output from the first printing section (book body printing section 41) coincides with the inserting order in unit of job to the bookbinding machine 90 of the second elements output from the second printing section (cover printing section 42), and prints the first elements in the determined printing order. When determining the printing order of the first elements, the first printing machine refers to the printing order data PD5, the apparatus related information of the first printing section (apparatus related information DD41), and the apparatus related information of the second printing section (apparatus related information DD42).

According to the printing system 40, since the first printing machine performs printing in the printing order determined based on the printing order data PD5 output from the second printing machine, the plurality of elements (book bodies 1 and covers 2) constituting the books can be output to the bookbinding machine 90 with a correct correspondence.

Fifth Embodiment

Figure 7:
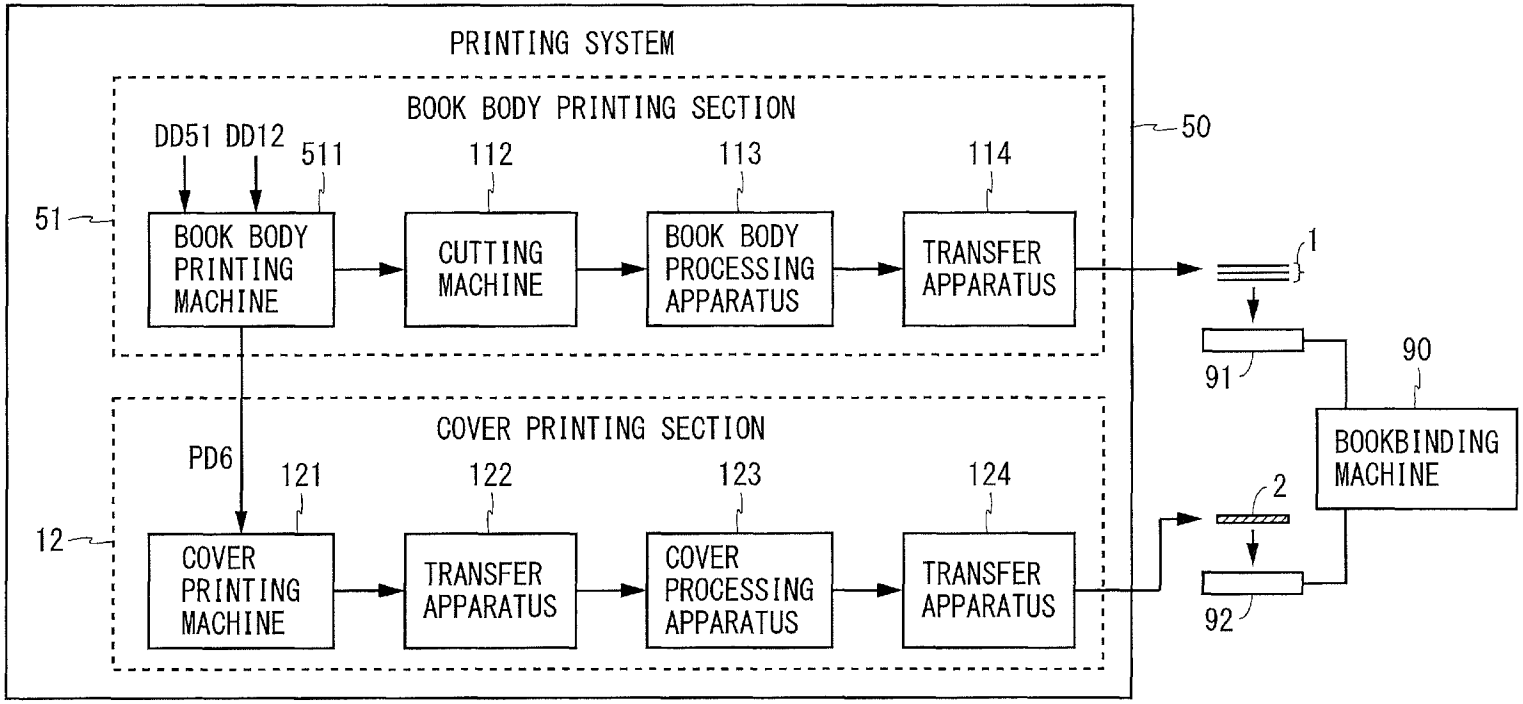
FIG. 7 is a block diagram showing a configuration of a printing system according to a fifth embodiment of the present invention.

FIG. 7 is a block diagram showing a configuration of a printing system according to a fifth embodiment of the present invention. A printing system 50 shown in FIG. 7 includes a book body printing section 51 and the cover printing section 12. The book body printing section 51 is obtained based on the book body printing section 11 according to the first embodiment by replacing the book body printing machine 111 with a book body printing machine 511.

The book body printing machine 511 is obtained by adding, to the book body printing machine 111, a function of outputting printing order data PD6. The book body printing machine 511 generates the printing order data PD6 indicating a printing order of the covers 2, based on a printing order at time of printing the book bodies 1 with regard to a plurality of jobs, apparatus related information DD51 of the book body printing section 51, and the apparatus related information DD12 of the cover printing section 12, and outputs the printing order data PD6 to the cover printing machine 121.

The cover printing machine 121 receives the printing order data PD6 from the book body printing machine 511, and prints the covers 2 in the printing order indicated by the printing order data PD6. The book body printing machine 511 determines the printing order of the covers 2, so that an inserting order in unit of job to the bookbinding machine 90 of the book bodies 1 output from the book body printing section 51 coincides with the inserting order in unit of job to the bookbinding machine 90 of the covers 2 output from the cover printing section 12.

As described above, in the printing system 50 according to the present embodiment, the first printing machine (book body printing machine 511) generates the printing order data PD6 indicating the printing order of the second elements (cover 2) based on the printing order at time of printing the first elements (book bodies 1) with regard to the plurality of jobs, and outputs the printing order data PD6 to the second printing machine (cover printing machine 121). The second printing machine prints the second elements in the printing order indicated by the printing order data PD6. The first printing machine generates the printing order data PD6, so that the inserting order in unit of job to the bookbinding machine 90 of the first elements output from the first printing section (book body printing section 51) coincides with the inserting order in unit of job to the bookbinding machine 90 of the second elements output from the second printing section (cover printing section 12). When generating the printing order data PD6, the first printing machine refers to the printing order of the first elements, the apparatus related information of the first printing section (apparatus related information DD51), and the apparatus related information of the second printing section (apparatus related information DD12).

According to the printing system 50, since the second printing machine performs printing in the printing order indicated by the printing order data PD6 output from the first printing machine, the plurality of elements (book bodies 1 and covers 2) constituting the books can be output to the bookbinding machine 90 with a correct correspondence.

Sixth Embodiment

Figure 8:
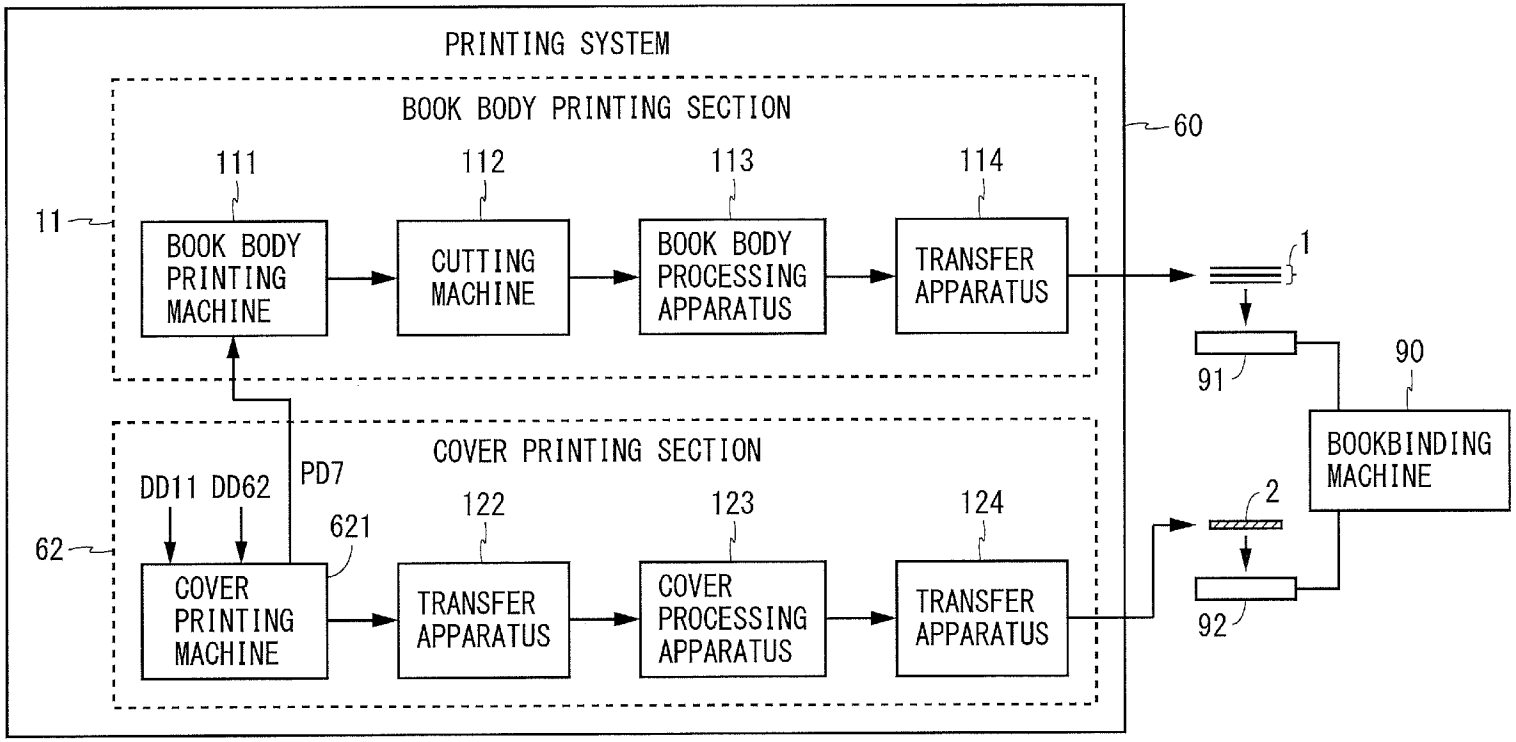
FIG. 8 is a block diagram showing a configuration of a printing system according to a sixth embodiment of the present invention.

FIG. 8 is a block diagram showing a configuration of a printing system according to a sixth embodiment of the present invention. A printing system 60 shown in FIG. 8 includes the book body printing section 11 and a cover printing section 62. The cover printing section 62 is obtained based on the cover printing section 12 according to the first embodiment by replacing the cover printing machine 121 with a cover printing machine 621.

The cover printing machine 621 is obtained by adding, to the cover printing machine 121, a function of outputting printing order data PD7. The cover printing machine 621 generates the printing order data PD7 indicating a printing order of the book bodies 1, based on a printing order at time of printing the covers 2 with regard to a plurality of jobs, the apparatus related information DD11 of the book body printing section 11, and apparatus related information DD62 of the cover printing section 62, and outputs the printing order data PD7 to the book body printing machine 111.

The book body printing machine 111 receives the printing order data PD7 from the cover printing machine 621, and prints the book bodies 1 in the printing order indicated by the printing order data PD7. The cover printing machine 621 determines the printing order of the book bodies 1, so that the inserting order in unit of job to the bookbinding machine 90 of the book bodies 1 output from the book body printing section 11 coincides with an inserting order in unit of job to the bookbinding machine 90 of the covers 2 output from the cover printing section 62.

As described above, in the printing system 60 according to the present embodiment, the second printing machine (cover printing machine 621) generates the printing order data PD7 indicating the printing order of the first elements (book bodies 1) based on the printing order at time of printing the second elements (covers 2) with regard to the plurality of jobs, and outputs the printing order data PD7 to the first printing machine (book body printing machine 111). The first printing machine prints the first elements in the printing order indicated by the printing order data PD7. The second printing machine generates the printing order data PD7, so that the inserting order in unit of job to the bookbinding machine 90 of the first elements output from the first printing section (book body printing section 11) coincides with the inserting order in unit of job to the bookbinding machine 90 of the second elements output from the second printing section (cover printing section 62). When generating the printing order data PD7, the second printing machine refers to the printing order of the second elements, the apparatus related information of the first printing section (apparatus related information DD11), and the apparatus related information of the second printing section (apparatus related information DD62).

According to the printing system 60, since the first printing machine performs printing in the printing order indicated by the printing order data PD7 output from the second printing machine, the plurality of elements (book bodies 1 and covers 2) constituting the books can be output to the bookbinding machine 90 with a correct correspondence.

Seventh Embodiment

Figure 9:
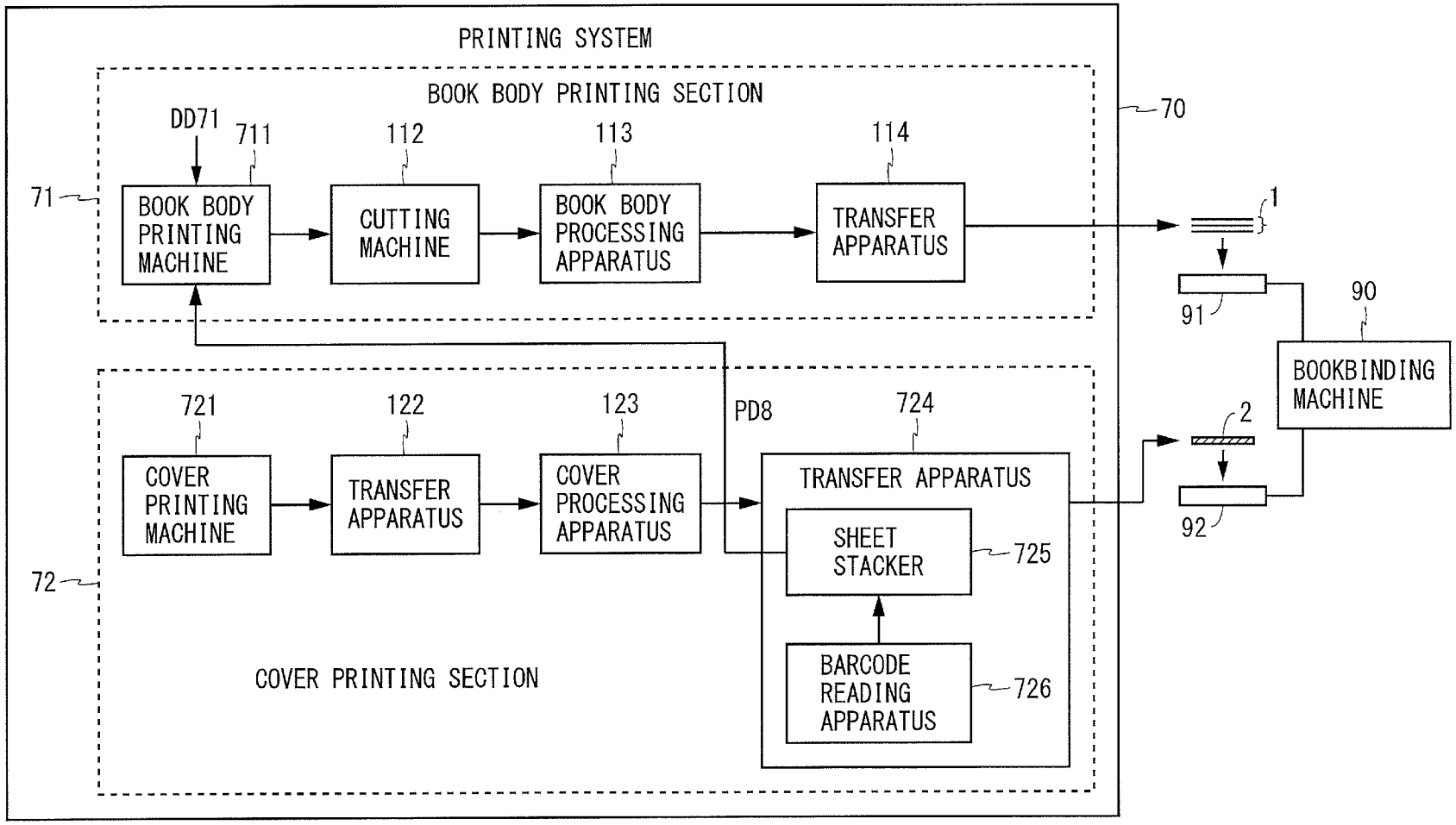
FIG. 9 is a block diagram showing a configuration of a printing system according to a seventh embodiment of the present invention.

FIG. 9 is a block diagram showing a configuration of a printing system according to a seventh embodiment of the present invention. A printing system 70 shown in FIG. 9 includes a book body printing section 71 and a cover printing section 72. The book body printing section 71 is obtained based on the book body printing section 11 according to the first embodiment by replacing the book body printing machine 111 with a book body printing machine 711. The cover printing section 72 is obtained based on the cover printing section 12 according to the first embodiment by replacing the cover printing machine 121 and the transfer apparatus 124 with a cover printing machine 721 and a transfer apparatus 724, respectively.

When printing the covers 2, the cover printing machine 721 prints barcodes on the covers 2 as job identification information. The transfer apparatus 724 includes a sheet stacker 725 that stacks the printed covers 2, and a barcode reading apparatus 726. The barcode reading apparatus 726 is attached to the sheet stacker 725, and reads the barcodes printed on the covers 2 to be stacked in the sheet stacker 725.

The sheet stacker 725 obtains an overlapping order in unit of job of the covers 2 output from the cover processing apparatus 123 (that is, the covers 2 printed by the cover printing machine 721), based on the barcodes read by the barcode reading apparatus 726. The sheet stacker 725 outputs data indicating the obtained overlapping order to the book body printing machine 711 as printing order data PD8.

The book body printing machine 711 receives the printing order data PD8 from the sheet stacker 725, determines a printing order of the book bodies 1 based on the printing order data PD8 and apparatus related information DD71 of the book body printing section 71, and prints the book bodies 1 in the determined order. The book body printing machine 711 determines the printing order of the book bodies 1, so that an inserting order in unit of job to the bookbinding machine 90 of the book bodies 1 output from the book body printing section 71 coincides with an inserting order in unit of job to the bookbinding machine 90 of the covers 2 output from the cover printing section 72. Note that when determining the printing order of the book bodies 1, the book body printing machine 711 may refer to apparatus related information DD72 (not shown) of the cover printing section 72, in addition to the printing order data PD8 and the apparatus related information DD71 of the book body printing section 71.

As described above, in the printing system 70 according to the present embodiment, the second printing section (cover printing section 72) further includes an order obtaining apparatus (sheet stacker 725 having barcode reading apparatus 726) that obtains an overlapping order in unit of job of the second elements (covers 2) printed by the second printing machine (cover printing machine 721), and outputs data indicating the obtained overlapping order to the first printing machine (book body printing machine 711) as the printing order data PD8. The first printing machine determines the printing order of the first elements based on the printing order data PD8, so that the inserting order in unit of job to the bookbinding machine 90 of the first elements (book bodies 1) output from the first printing section (book body printing section 71) coincides with the inserting order in unit of job to the bookbinding machine 90 of the second elements output from the second printing section (cover printing section 72), and prints the first elements in the determined printing order. When determining the printing order of the first elements, the first printing machine refers to the printing order data PD8 and the apparatus related information of the first printing section (apparatus related information DD71). At this time, the first printing machine may refer to the apparatus related information of the second printing section (apparatus related information DD72).

According to the printing system 70, since the first printing machine performs printing in the printing order determined based on the printing order data PD8 output from the order obtaining apparatus included in the second printing section, the plurality of elements (book bodies 1 and covers 2) constituting the books can be output with a correct correspondence.

Note that in FIG. 9, the sheet stacker 725 having the barcode reading apparatus 726 is provided in the transfer apparatus 724 existing in a later stage of the cover processing apparatus 123. In place of this, an order obtaining apparatus such as a sheet stacker having a barcode reading apparatus may be provided at an arbitrary position later than the cover printing machine 721. Furthermore, information other than the barcode may be used as the job identification information.

In the printing systems 10, 20 according to the first and second embodiments, the first printing machine and the second printing machine perform printing in the printing order indicated by the received printing order data. In the printing system 30 according to the third embodiment, the second printing machine performs printing in the printing order determined based on the received printing order data. In the printing systems 40, 70 according to the fourth and seventh embodiments, the first printing machine performs printing in the printing order determined based on the received printing order data. In the printing system 50 according to the fifth embodiment, the second printing machine performs printing in the printing order indicated by the received printing order data. In the printing system 60 according to the sixth embodiment, the first printing machine performs printing in the printing order indicated by the received printing order data. In the printing systems according to the embodiments of the present invention, at least one of the first printing machine and the second printing machine receives the printing order data, and the at least one of the first printing machine and the second printing machine performs printing referring to the printing order data so that the inserting order in unit of job to the bookbinding machine of the first elements output from the first printing section coincides with the inserting order in unit of job to the bookbinding machine of the second elements output from the second printing section.

As for the above-described printing systems according to each embodiment, a variety of modification examples can be configured. For example, although in the above description, the second element constituting the book is the cover, the second element may be an element other than the cover (for example, a page on which a picture is color-printed, or the like). The number of the book body printing machine(s) included in the book body printing section is arbitrary, and the number of the cover printing machine(s) included in the cover printing section is also arbitrary. The cover printing section may include a plurality of processing apparatuses of different kinds. The book body printing section may include another apparatus, and the cover printing section may also include another apparatus.

Furthermore, in each of the above-described embodiments, the book bodies 1 in unit of book block are inserted to the slot 91 of the bookbinding machine 90 one by one, and the covers 2 are inserted to the slot 92 of the bookbinding machine 90 one by one. In place of this, the book bodies 1 of a plurality of book blocks may be inserted to the slot 91 in an overlapping state, or a plurality of covers 2 may be inserted to the slot 92 in an overlapping state. Furthermore, in each of the above-described embodiments, the transfer apparatus provided in a later stage of the cover processing apparatuses 123, 223 transfers the covers 2 one by one. In place of this, a transfer apparatus provided in the later stage of the cover processing apparatuses 123, 223 may transfer a plurality of covers 2 in an overlapping state.

Although the present invention is described in detail in the above, the above description is exemplary in all of the aspects and is not restrictive. It is understood that various other changes and modification can be derived without going out of the present invention.

This application claims a priority based on Japanese Patent Application No. 2020-59762 filed on Mar. 30, 2020, and entitled "Printing System", which is incorporated herein by reference in its entirety.

What is claimed is:

1. A printing system that outputs first elements and second elements to a bookbinding machine performing bookbinding of books by combining the first elements and the second elements, the system comprising:

a first printing section including a first printing machine configured to print the first elements with regard to a plurality of jobs, the first printing section configured to output the first elements sequentially;

a second printing section including a second printing machine configured to print the second elements with regard to the plurality of jobs, the second printing section configured to output the second elements sequentially; and a print control apparatus configured to generate first printing order data indicating a printing order of the first elements by the first printing machine and second printing order data indicating a printing order of the second elements by the second printing machine, to output the first printing order data to the first printing machine, and to output the second printing order data to the second printing machine, wherein the first printing machine is configured to print the first elements in the printing order indicated by the first printing order data, the second printing machine is configured to print the second elements in the printing order indicated by the second printing order data, the print control apparatus generates the first printing order data based on first apparatus related information including information indicating a correspondence relation between a printing order of the plurality of jobs in the first printing machine and an output order of the first elements output from the first printing section and generates the second printing order data based on second apparatus related information including information indicating a correspondence relation between a printing order of the plurality of jobs in the second printing machine and an output order of the second elements output from the second printing section, and the print control apparatus is configured to generate the first printing order data and the second printing order data, so that an inserting order in unit of job to the bookbinding machine of the first elements output from the first printing section coincides with an inserting order in unit of job to the bookbinding machine of the second elements output from the second printing section.

2. The printing system according to claim 1, wherein the first element is a book body, and the second element is a cover.

3. The printing system according to claim 1, wherein the first printing machine is a continuous feed printing machine, and the second printing machine is a sheet fed printing machine.

4. The printing system according to claim 1, wherein the second printing section further includes a processing apparatus configured to perform processing other than printing on the second elements printed by the second printing machine.

5. A printing system that outputs first elements and second elements to a bookbinding machine performing bookbinding of books by combining the first elements and the second elements, the system comprising:

a first printing section including a first printing machine configured to print the first elements, the first printing section configured to output the first elements sequentially; and a second printing section including a second printing machine configured to print the second elements, the second printing section configured to output the second elements sequentially, wherein at least one of the first printing machine and the second printing machine is configured to receive printing order data indicating a printing order with regard to a plurality of jobs, the at least one of the first printing machine and the second printing machine is configured to perform printing referring to the printing order data so that an inserting order in unit of job to the bookbinding machine of the first elements output from the first printing section coincides with an inserting order in unit of job to the bookbinding machine of the second elements output from the second printing section, the second printing machine is configured to generate the printing order data indicating the printing order at time of printing the second elements with regard to the plurality of jobs, and to output the printing order data to the first printing machine, and the first printing machine is configured to determine a printing order of the first elements based on the printing order data, so that the inserting order in unit of job to the bookbinding machine of the first elements output from the first printing section coincides with the inserting order in unit of job to the bookbinding machine of the second elements output from the second printing section, and to print the first elements in the determined printing order.

6. The printing system according to claim 5, wherein the first element is a book body, and the second element is a cover.

7. The printing system according to claim 5, wherein the first printing machine is a continuous feed printing machine, and the second printing machine is a sheet fed printing machine.

8. The printing system according to claim 5, wherein the second printing section further includes a processing apparatus configured to perform processing other than printing on the second elements printed by the second printing machine.

9. A printing system that outputs first elements and second elements to a bookbinding machine performing bookbinding of books by combining the first elements and the second elements, the system comprising:

a first printing section including a first printing machine configured to print the first elements, the first printing section configured to output the first elements sequentially; and a second printing section including a second printing machine configured to print the second elements, the second printing section configured to output the second elements sequentially, wherein at least one of the first printing machine and the second printing machine is configured to receive printing order data indicating a printing order with regard to a plurality of jobs, the at least one of the first printing machine and the second printing machine is configured to perform printing referring to the printing order data so that an inserting order in unit of job to the bookbinding machine of the first elements output from the first printing section coincides with an inserting order in unit of job to the bookbinding machine of the second elements output from the second printing section, the second printing section includes an order obtaining apparatus configured to obtain an overlapping order in unit of job of the second elements printed by the second printing machine, and to output data indicating the overlapping order as the printing order data to the first printing machine, and the first printing machine is configured to determine a printing order of the first elements based on the printing order data, so that the inserting order in unit of job to the bookbinding machine of the first elements output from the first printing section coincides with the inserting order in unit of job to the bookbinding machine of the second elements output from the second printing section, and to print the first elements in the determined printing order.

10. The printing system according to claim 9, wherein the first element is a book body, and the second element is a cover.

11. The printing system according to claim 9, wherein the first printing machine is a continuous feed printing machine, and the second printing machine is a sheet fed printing machine.

12. The printing system according to claim 9, wherein the second printing section further includes a processing apparatus configured to perform processing other than printing on the second elements printed by the second printing machine.

* * * * *